US010795286B1

(12) United States Patent
Tanaka et al.

(10) Patent No.: US 10,795,286 B1
(45) Date of Patent: Oct. 6, 2020

(54) DEVELOPER CONTAINER AND IMAGE FORMING APPARATUS

(71) Applicant: FUJI XEROX CO., LTD., Tokyo (JP)

(72) Inventors: Hideaki Tanaka, Kanagawa (JP); Taiyou Uehara, Kanagawa (JP); Daisuke Nakai, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/724,606

(22) Filed: Dec. 23, 2019

(30) Foreign Application Priority Data

Apr. 2, 2019 (JP) ..... 2019-070276

(51) Int. Cl.
*G03G 15/08* (2006.01)

(52) U.S. Cl.
CPC ..... *G03G 15/0891* (2013.01)

(58) Field of Classification Search
CPC ..... G03G 15/0891; G03G 15/0877; G03G 15/0879; G03G 15/0865; G03G 15/0867
See application file for complete search history.

(56) References Cited

U.S. PATENT DOCUMENTS 5,270,785 A * 12/1993 Kita ..... G03G 15/0877 222/DIG. 1
2004/0179866 A1* 9/2004 Muramatsu ..... G03G 15/0877 399/258
2017/0242369 A1* 8/2017 Yada ..... G03G 15/0891
2019/0056681 A1* 2/2019 Sakai ..... G03G 15/0879

FOREIGN PATENT DOCUMENTS

JP 07-013421 A 1/1995

* cited by examiner

*Primary Examiner* — Sandra Brase
(74) *Attorney, Agent, or Firm* — Sughrue Mion, PLLC

(57) ABSTRACT

A developer container includes a container body, a transport unit, a support unit, and a protrusion. The container body includes a cylindrical accommodating space that accommodates a developer, and a discharge port. The transport unit transports the accommodated developer toward the discharge port by a transport blade. The transport blade moves so as to pass closely to an inner wall of the accommodating space. The support unit rotatably supports a rotating shaft of the transport unit. The support unit includes a connecting component that connects to an external element to receive external rotational power. The protrusion protrudes inward from the inner wall. When the transport unit reversely rotates in an opposite direction to a rotational direction in transporting the developer, the transport blade passes in contact with the protrusion and vibrates so as to touch the inner wall of the accommodating space.

19 Claims, 13 Drawing Sheets

DEVELOPER CONTAINER AND IMAGE FORMING APPARATUS

CROSS-REFERENCE TO RELATED APPLICATION(S)

This application is based on and claims priority under 35 USC 119 from Japanese Patent Application No. 2019-070276 filed on Apr. 2, 2019.

BACKGROUND

(i) Technical Field

The present disclosure relates to a developer container and an image forming apparatus.

(ii) Related Art

In the related art, as a technology related to a toner accommodating container that accommodates a replenishment developer (mainly toner), there has been known, for example, a technology described in JP-A-7-013421.

JP-A-7-013421 describes a technology of preventing toner aggregation by providing a toner accommodating container used in a toner replenishing device with a toner agitating unit that agitates a toner accommodated in the container, a coil-shaped swingable member that comes into contact with the toner agitating unit, and a diaphragm formed of an elastic member that swings in contact with the coil-shaped swingable member.

SUMMARY

Aspects of non-limiting embodiments of the present disclosure relates to a developer container capable of dropping a developer adhered to an inner wall thereof to reduce the remaining amount of the developer at the time of replacement and an image forming apparatus using the developer container.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a developer container including: a container body including a cylindrical accommodating space that accommodates a developer, and a discharge port through which the developer is discharged; a transport unit configured to transport the developer accommodated in the accommodating space of the container body toward the discharge port by a transport blade that is provided on a rotating shaft existing along a longitudinal direction in the accommodating space, the transport blade being configured to move so as to pass closely to an inner wall of the accommodating space; a support unit that rotatably supports the rotating shaft of the transport unit, the support unit including a connecting component configured to connect to an external element to receive external rotational power; and a protrusion protruding inward from the inner wall of the accommodating space of the container body, in which the transport unit is configured such that when the transport unit reversely rotates in an opposite direction to a rotational direction in transporting the developer, the transport blade passes in contact with the protrusion and vibrates so as to touch the inner wall of the accommodating space.

BRIEF DESCRIPTION OF THE DRAWINGS

Exemplary embodiment(s) of the present disclosure will be described in detail based on the following figures, wherein.

DETAILED DESCRIPTION

Hereinafter, exemplary embodiments for carrying out the present disclosure will be described with reference to the drawings.

First Exemplary Embodiment

Figure 1:
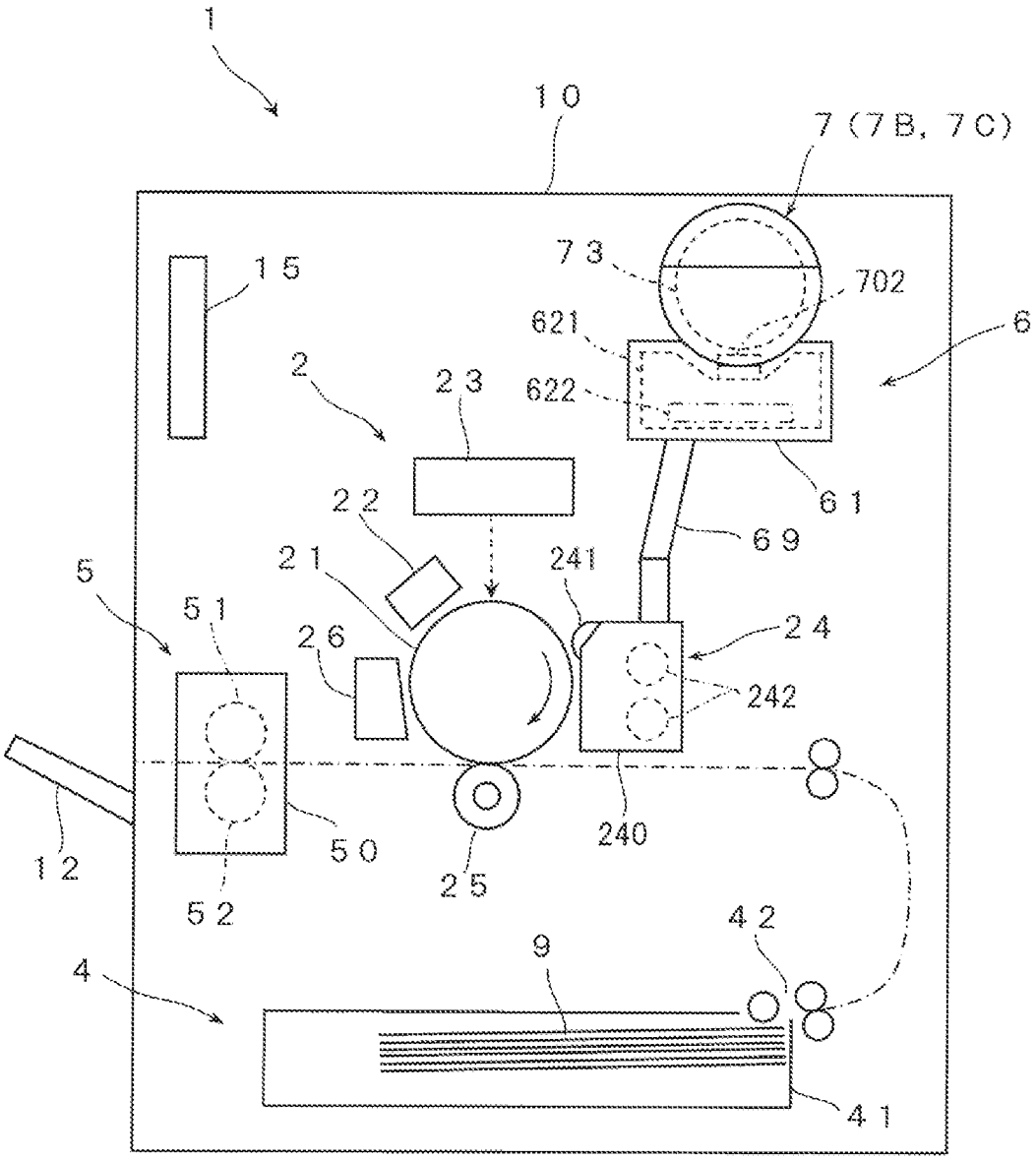
FIG. 1 is a schematic view illustrating a configuration of an image forming apparatus according to a first exemplary embodiment.

FIG. 1 conceptually illustrates a configuration of an image forming apparatus equipped with a developer container according to a first exemplary embodiment.

Image Forming Apparatus

The image forming apparatus 1 is an apparatus that forms an image with a toner as a developer on a sheet 9 which is an example of a recording medium using an image forming method such as an electrophotographic method. The image forming apparatus 1 is configured as, for example, a printer that forms an image corresponding to image information such as characters, figures, tables, and photographs input from an external device such as an information terminal or an image reading device.

As illustrated in FIG. 1, the image forming apparatus 1 includes, in the internal space of a case 10, an image forming unit 2 which forms a toner image by an image forming method such as an electrophotographic method and transfers the toner image onto the sheet 9, a sheet feeding unit 4 which accommodates and sends the sheet 9 to be supplied to the image forming unit 2, a fixing unit 5 which fixes the toner image transferred by the image forming unit 2 onto the sheet 9, and a replenishing unit 6 which replenishes a developing device 24 in the image forming unit 2 with a developer. A one-dot dashed line illustrated in FIG. 1 is a main transport path along which the sheet 9 is transported in the internal space of the case 10. Further, reference numeral 15 in FIG. 1 denotes a controller that controls each operation of the image forming apparatus 1.

The image forming unit 2 includes a photoconductive drum 21 as an example of a photoconductor which is an example of an image carrier that rotates in a direction indicated by the arrow, and, further includes, around the photoconductive drum 21, a charging device 22 that charges an image forming area on the peripheral surface of the photoconductive drum 21 to a required potential, an exposure device 23 that forms an electrostatic latent image by exposing the charged image forming area of the photoconductive drum 21 based on image information, a developing device 24 that develops the electrostatic latent image formed on the photoconductive drum 21 into a toner image with the developer, a transfer device 25 that transfers the toner image formed on the photoconductive drum 21 onto the sheet 9, and a cleaning device 26 that cleans the image forming area of the photoconductive drum 21.

Among these, as illustrated in FIG. 1, the developing device 24 includes a case 240 having an accommodating chamber that accommodates the developer and a development opening for the implementation of development, a developing roller 241 that carries and transports the developer so as to pass through a developing area facing the photoconductive drum 21, and a transport unit 242 that transports the developer so as to pass through the developing roller while agitating the developer in the accommodating chamber, the developing roller 241 and the transport unit 242 being provided inside the case 240. As the developer, for example, a two-component developer containing a toner and a carrier is used.

Further, since the developer in the accommodating chamber of the case 240 is consumed and reduced by development, the developing device 24 is replenished with the developer from the replenishing unit 6.

The sheet feeding unit 4 includes a receptor 41 (not illustrated) which accommodates multiple sheets 9 having a desired size and type in a stacked state, and a delivery device 42 which sends the sheets 9 from the receptor 41 one by one to a transfer section in the image forming unit 2. The sheet 9 may be a recording medium which may be transported in the image forming apparatus 1 and onto which the toner image may be transferred and fixed.

The fixing unit 5 includes, inside a case (housing) 50 provided with an introduction port (not illustrated) and a discharge port (not illustrated) for the sheet 9, a heating rotator 51 formed in a roller form or in a belt-nip form to rotate while being heated by a heating unit (not illustrated) and a pressing rotator 52 formed in a roller form or in a belt-nip form to form a fixing nip in contact with the heating rotator 51 with a required pressure.

When the image forming apparatus 1 receives request command information for an image forming operation, first, the image forming unit 2 performs known processes (charging, exposure, development and transfer processes) of an image forming method such as an electrophotographic method.

That is, in the image forming unit 2, the toner image corresponding to image information is formed on the photoconductive drum 21 through charging, exposure and development processes, and then the toner image on the photoconductive drum 21 is transferred onto one side of the sheet 9 supplied from the sheet feeding unit 4 in the transfer process. After the transfer process, the photoconductive drum 21 is cleaned by the cleaning device 26.

Subsequently, the sheet 9 carrying the toner image transferred by the image forming unit 2 is introduced into the fixing nip in the fixing unit 5, and is subjected to a fixing processing (heating and pressing) when passing through the fixing nip, so that the toner image is fixed onto the sheet 9. The sheet 9 on which the toner image has completely been fixed by the fixing unit 5 is transported to and accommodated in, for example, a discharge receptor 12 provided outside the case 10.

In this way, the image forming operation for one side of the sheet 9 by the image forming apparatus 1 is completed.

Figure 2:
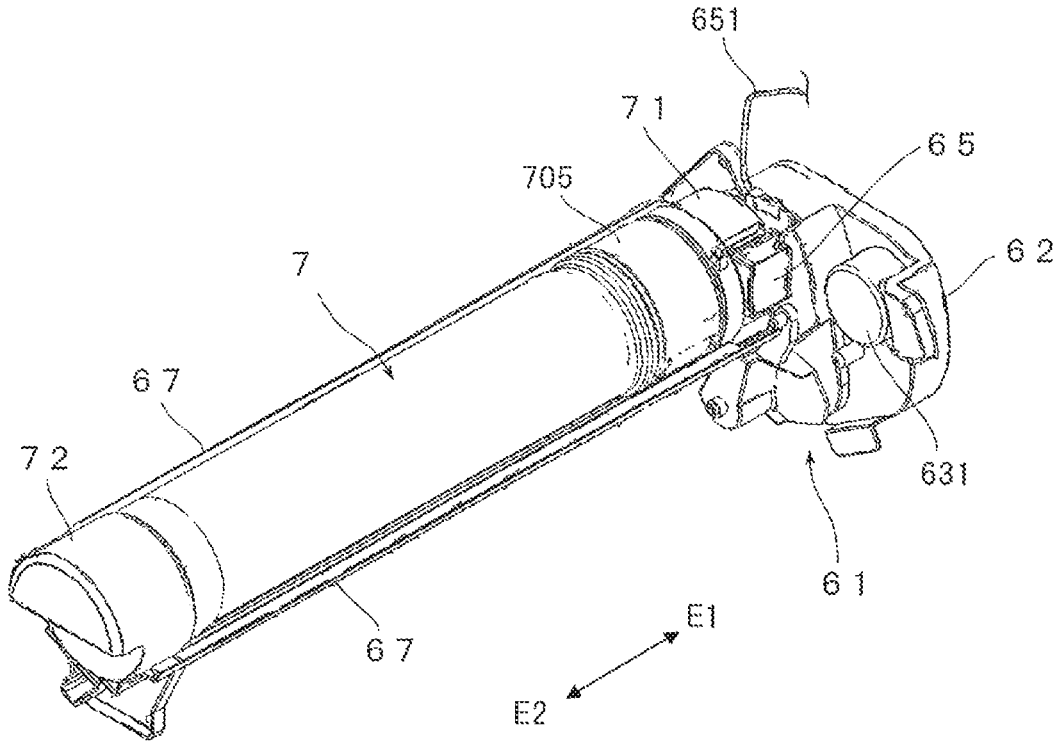
FIG. 2 is a schematic perspective view illustrating a configuration of a developer container and a replenishing unit in the image forming apparatus of FIG. 1.

Next, as illustrated in FIG. 1 or FIG. 2, the replenishing unit 6 includes a developer container 7 which accommodates the developer to be replenished, a replenishment drive device 61 which sends the developer accommodated in the developer container 7 to the developing device 24 so as to replenish the developer at a required time and in a required amount, and a transport pipe 69 which transports the developer sent by the replenishment drive device 61 to the developing device 24.

The replenishment drive device 61 includes a housing 62 which is also a device body and a container holding unit 67 integrally disposed on one side of the housing 62 to hold the developer container 7.

Figure 3:
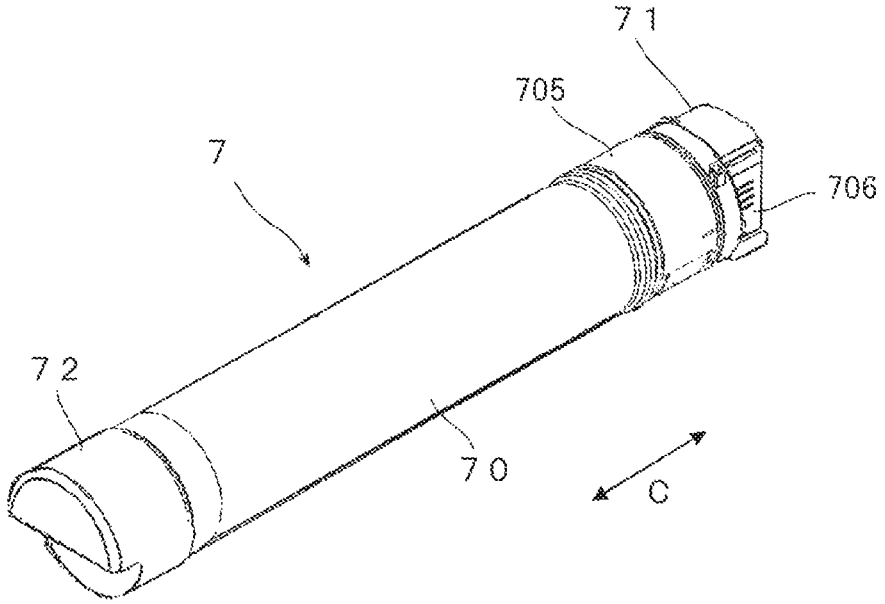
FIG. 3 is a schematic perspective view illustrating a state where the developer container and the replenishing unit of FIG. 2 are separated from each other.
Figure 3:
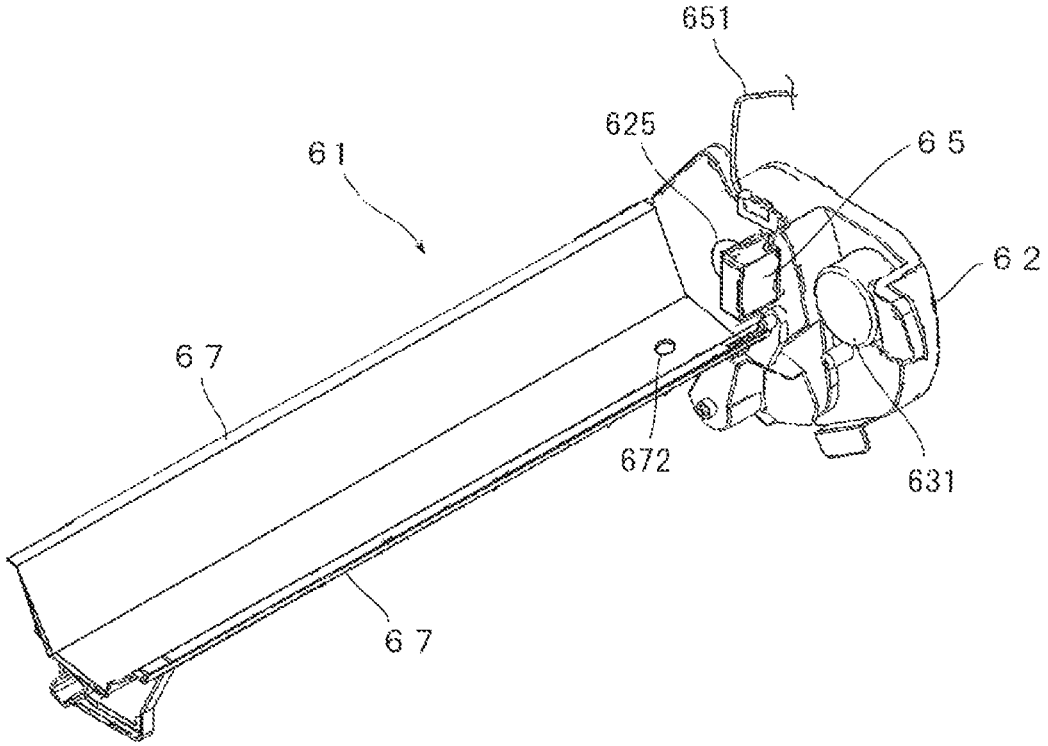

Further, as illustrated in FIG. 2 or FIG. 3, the replenishment drive device 61 is provided with a connector unit 65 for making an electrical connection with a storage medium 706 mounted to the developer container 7. The connector unit 65 is connected to the controller 15 via a cable harness 651.

The housing 62 includes therein an accommodating and transport unit 621 (not illustrated) that temporarily accommodates the developer discharged from the developer container 7 and sends a required amount of the developer toward the transport pipe 69, a delivery member 622 that is driven to send the developer accommodated in the accommodating and transport unit 621 toward the transport pipe 69, and a rotational drive device 63 that generates and transmits rotational power, and the like.

Further, an electric motor 631 which is a power source of the rotational drive device 63 is attached to the housing 62. The rotational power of the electric motor 631 is transmitted to the delivery member 622 inside the housing 62 or a transport unit 73 of the developer container 7 held by the container holding unit 67 via a driving transmission mechanism 632 such as a gear train.

Figure 5:
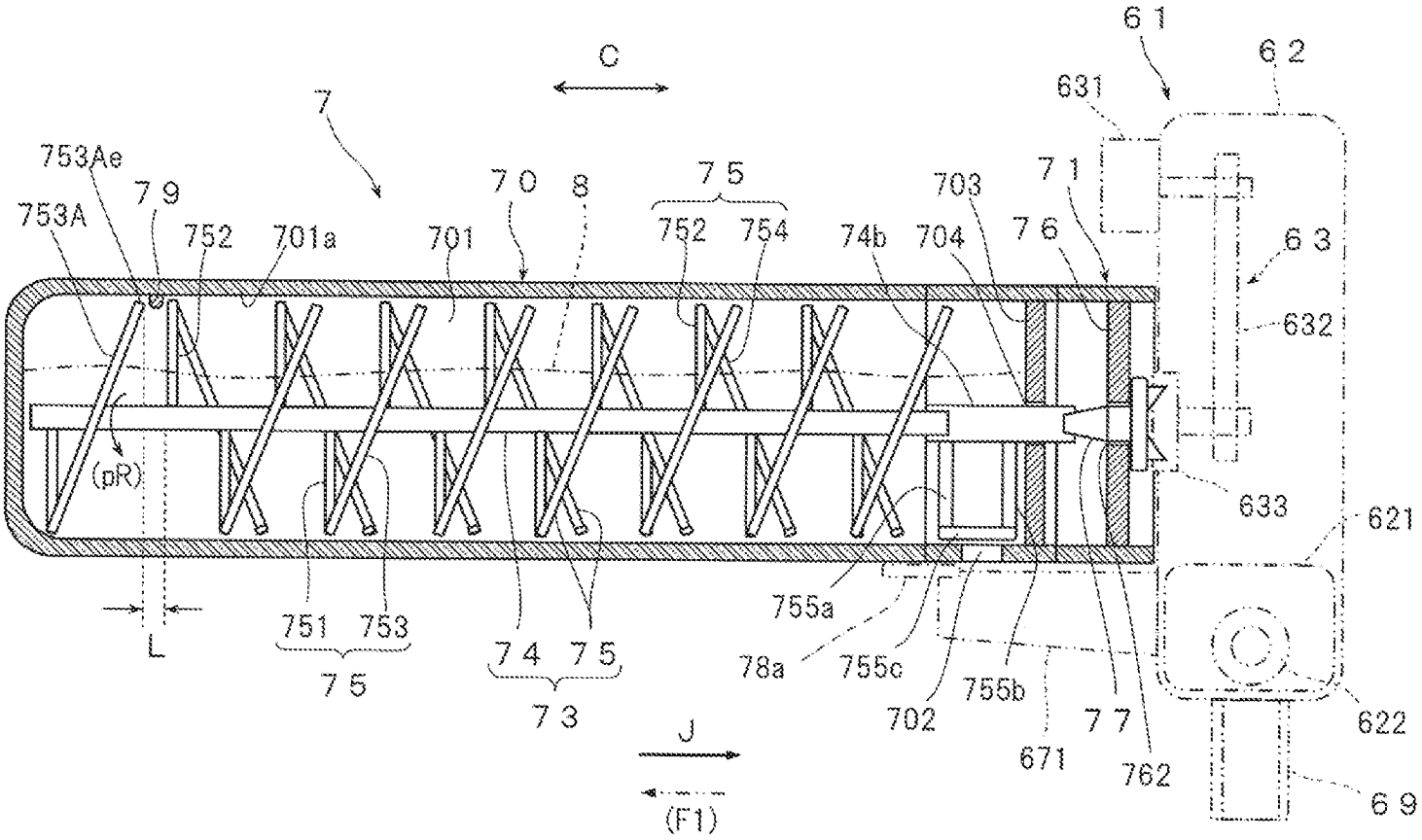
FIG. 5 is a schematic partial cross-sectional view illustrating a state of the developer container and the replenishing unit when a transport unit rotates forward.

In addition, as illustrated in FIG. 3 or FIG. 5, the housing 62 is provided in a side surface portion thereof facing the container holding unit 67 with an opening 625 through which a connecting component 77 of the developer container 7 passes. Further, a connecting member 633 such as a coupling which is connected to the connecting component 77 to transmit the rotational power passes through the opening 625 and is disposed inside the housing 62 on the back side.

As illustrated in FIG. 2 or FIG. 3, the container holding unit 67 holds a lower portion of the developer container 7 along the longitudinal direction. Further, as illustrated in FIG. 5, the container holding unit 67 is provided on the end thereof facing the housing 62 with a connection passage 671 which sends the developer discharged from a discharge port 702 of the developer container 7 to the accommodating and transport unit of the housing 62. In addition, as illustrated in FIG. 3, a developer receiving hole 672 is provided in the bottom portion of the container holding unit 67 at a back side position so that the developer discharged from the discharge port 702 of the developer container 7 to be described later passes through the developer receiving hole 672 and drops into the connection passage 671.

As illustrated in FIG. 1, the transport pipe 69 is disposed so as to interconnect the replenishment drive device 61 and the developing device 24. The transport pipe 69 includes a transport pipe that transports the developer sent from the replenishment drive device 61 by naturally dropping the developer or a transport pipe that transports the developer by a driving transport unit.

Developer Container

The developer container 7 is detachably mounted to a mounting portion (not illustrated) of the case 10 of the image forming apparatus 1 when in use. Additionally, the container holding unit 67 of the replenishment drive device 61 constitutes a portion of the mounting portion to which the developer container 7 is mounted.

Figure 4:
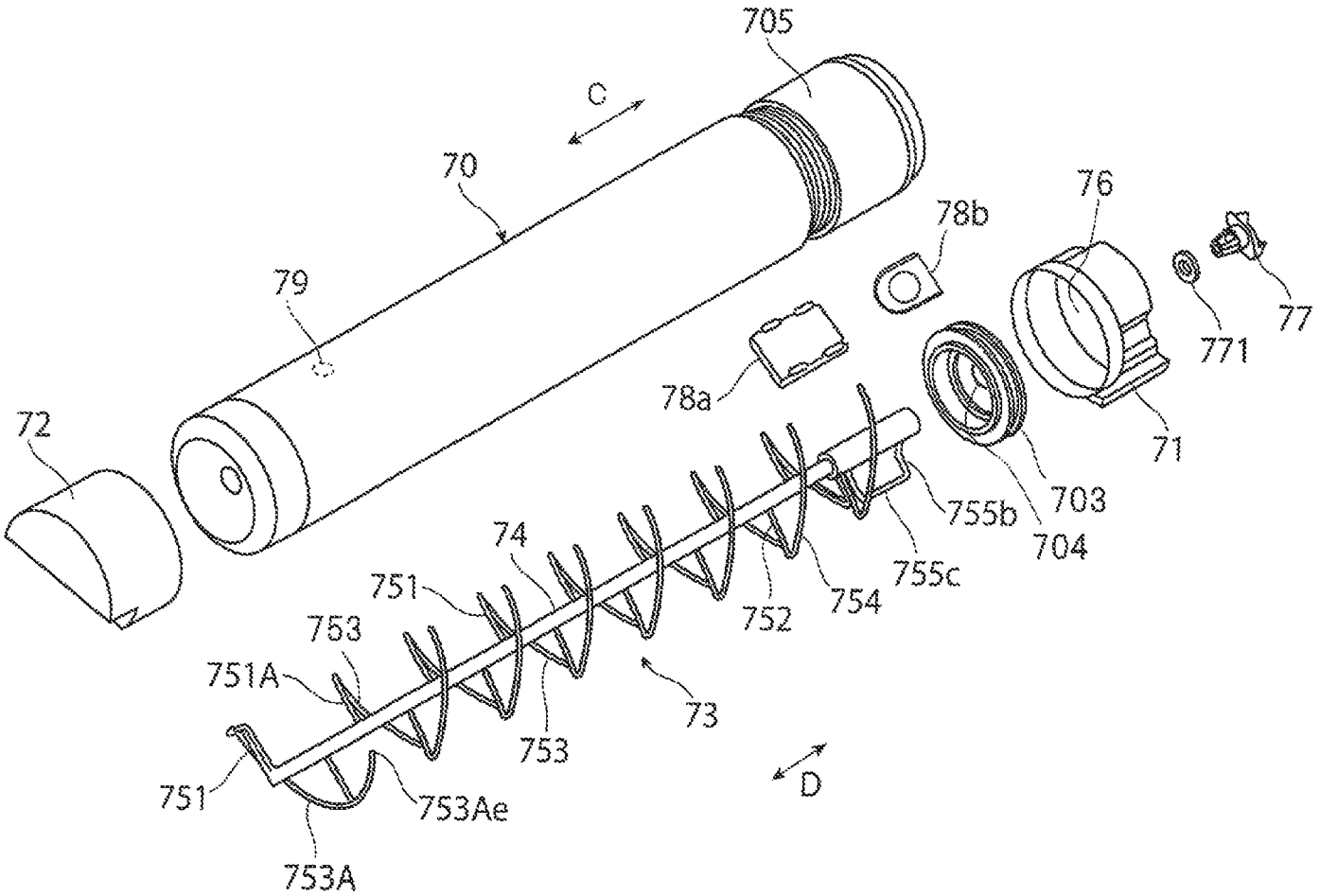
FIG. 4 is a schematic perspective view illustrating an exploded state of the developer container.

As illustrated in FIGS. 2 to 4, the developer container 7 includes a container body 70 in which a replenishment developer 8 is accommodated, a back side end structure 71 attached to one end of the container body 70 on the back side when the container body 70 is mounted, a front side end structure 72 attached to the other end of the container body 70 on the front side when the container body 70 is mounted, the transport unit 73 which transports the developer 8 accommodated in the container body 70 in a given direction (toward the end side provided with the discharge port), and a support unit 76 which is an example of a support unit provided on the end surface portion of the back side end structure 71 to rotatably support the transport unit 73.

The replenishment developer 8 is a toner alone or a toner containing a small amount of carrier. Further, in FIG. 2, the arrow indicated by reference numeral E1 denotes a pushing direction that is a movement direction when the developer container 7 is mounted, and the arrow indicated by reference numeral E2 denotes a pulling direction that is a movement direction when the developer container 7 is removed.

As illustrated in FIGS. 4 and 5, the container body 70 is formed as a container shaped to have a cylindrical accommodating space 701 that accommodates the replenishment developer 8 and the discharge port 702 through which the developer 8 is discharged. The back side end of the container body 70 according to the first exemplary embodiment includes a discharge structure portion 705 which is provided with the discharge port 702 and an opening and closing shutter 78*a* which opens and closes the discharge port 702 at the time of the attachment or detachment of the developer container 7. The discharge port 702 is provided in a portion of the developer container 7 which becomes the lower side when the developer container 7 is used. Reference numeral 78*b* in FIG. 4 denotes a seal member which prevents the developer from leaking out between the discharge port 702 and the opening and closing shutter 78*a*. The seal member 78 is attached to the discharge port 702.

The back side end structure 71 is configured to close an opening in the back side end of the container body 70 and to have the support unit 76 provided on the end surface portion thereof to support a rotating shaft of the transport unit 73. Reference numeral 703 illustrated in FIG. 4 denotes a sealing member that is fitted into the opening in the back side end of the container body 70 to seal the opening in the end and to prevent the developer from leaking from a joint portion when the back side end of the container body 70 and the back side end structure 71 are attached to each other.

The front side end structure 72 is configured to protect the front side end of the container body 70 and to have the function of a handle for holding the developer container 7 by hand when the developer container 7 is attached or detached.

As illustrated in FIGS. 4 and 5, the transport unit 73 includes a rotating shaft 74 disposed along the longitudinal direction C in the accommodating space 701 and a transport blade 75 that is provided on the rotating shaft 74 and moves so as to pass closely to an inner wall 701*a* of the accommodating space 701.

The transport unit 73 transports the developer 8 accommodated in the accommodating space 701 of the container body 70 toward the back side end in which the discharge port 702 is located by the transport blade 75 which rotates forward (pR) in the rotational direction in transporting the developer 8 about the rotating shaft 74.

Figure 7:
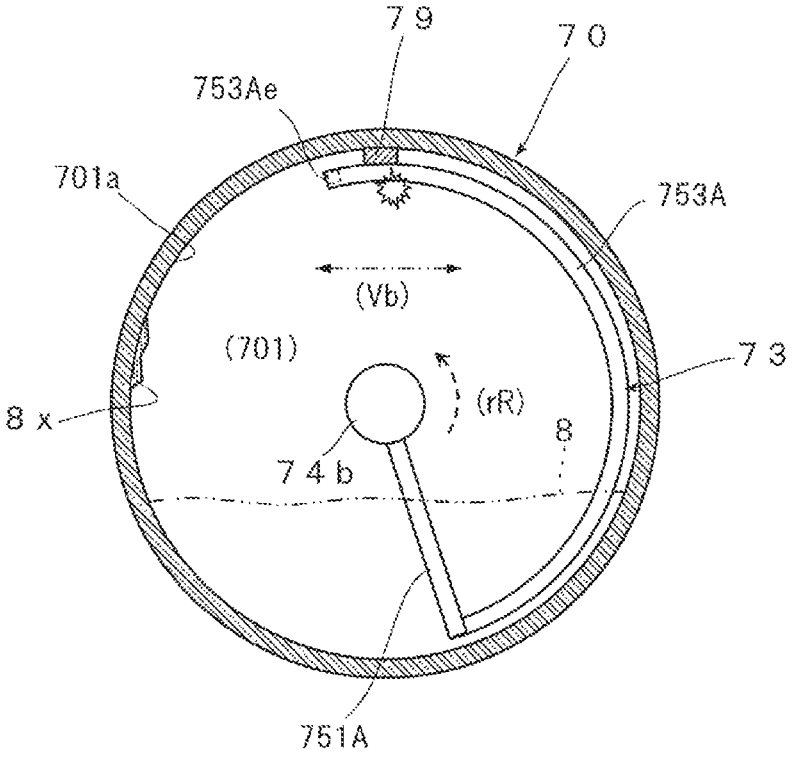
FIG. 7 is a schematic partial cross-sectional view illustrating a state where the transport unit rotates in reverse so as to pass in contact with a protrusion in the developer container.

As illustrated in FIGS. 4, 5 and 7, the transport blade 75 of the transport unit 73 according to the first exemplary embodiment includes a first column portion 751 and a second column portion 752 which linearly extend in opposite radial directions from the outer peripheral surface of the rotating shaft 74 to a position close to the inner wall 701*a* of the accommodating space 701, a first transport blade portion 753 and a second transport blade portion 754 which spirally bend and extend in the area which is about a half the circumference of the circular cross section of the cylindrical accommodating space 701 from the respective tip ends of the first column portion 751 and the second column portion 752, and a third transport blade portion 755 which passes closely to the discharge port 702.

The first column portion 751 and the second column portion 752 are elongated plate-shaped portions which linearly extend, and are provided at a predetermined gap in the axial direction D.

The first transport blade portion 753 and the second transport blade portion 754, for example, spirally bend and extend and the cross section of which has a rectangular flat plate shape. The first transport blade portion 753 and the second transport blade portion 754 are portions serving as transport portions. The first transport blade portion 753 and the second transport blade portion 754 are provided in a state where they spirally bend and extend from the respective tip ends of the first column portion 751 and the second column portion 752 along the cylindrical inner wall 701*a* of the accommodating space 701 to reach a position that slightly exceeds the neighboring first column portion 751 or the neighboring second column portion 752 which initially exists in the axial direction D. That is, the first transport blade portion 753 and the second transport blade portion 754 are in an individually discontinuous state and are also in a mutually discontinuous state. Further, as illustrated in FIG. 5, the first transport blade portion 753 and the second transport blade portion 754 are also in a state where neighboring portions thereof (excluding a portion that becomes a completely discontinuous state to be described later) are partially superimposed on each other in the axial direction D.

The third transport blade portion 755 is provided in a shape having two column portions 755*a* and 755*b* which substantially linearly extend adjacent to each other in the same direction from opposite portions of the rotating shaft 74 about the discharge port 702 to positions close to the inner wall 701*a* of the accommodating space 701 and a transport portion 755*c* which has an elongated plate shape and extends linearly in parallel to the axial direction D from the tip ends of the column portions 755*a* and 755*b*.

The transport unit 73 in which the transport blade 75 is formed of a member such as a wire rod is also referred to as an agitator. Further, the transport unit 73 is formed of, for example, a synthetic resin such as polyacetal, and the rotating shaft 74 or the transport blade 75 has physical properties to slightly elastically deform and bend when the transport blade 75 receives an external force.

As illustrated in FIG. 5, the support unit 76 in the back side end structure 71 includes a disk-shaped member in which a support hole 762 is provided in the center of the circular end surface portion of the end structure 71. The support unit 76 rotatably supports one end portion 74*b* of the rotating shaft 74 of the transport unit 73 in a cantilever manner. At this time, the end portion 74*b* of the rotating shaft 74 is an end portion on the side close to the discharge port 702, and is connected to the connecting component 77 to be described later. Further, in the first exemplary embodiment, the end portion 74*b* of the rotating shaft 74 is rotatably supported in the support hole 762 of the support unit 76 via the connecting component 77 to be described later. In addition, according to the first exemplary embodiment, the end portion 74*b* of the rotating shaft 74 is positioned through a through-hole provided in the center of the sealing member 703 and is attached so as to be connected to the connecting component 77 to be described later.

Further, the support unit 76 includes the connecting component 77 that connects to the connecting member 633 to receive external rotational power to be transmitted to the rotating shaft 74 of the transport unit 73.

As illustrated in FIG. 5, the connecting component 77 includes a connecting member such as a coupling which is detachably connected to the connecting member 633 of the replenishment drive device 61. The connecting component 77 is connected to the connecting member 633 in a join state where one end thereof opposite to the other end connected to the connecting member 633 is joined to the end portion 74*b* of the rotating shaft 74 of the transport unit 73 with a slight gap (backlash) in the axial direction D. Further, the connecting component 77 is disposed in a state of being externally exposed from the back side end structure 71 in order to provide connection with the connecting member 633 when the developer container 7 is mounted. Reference numeral 771 in FIG. 4 is a seal member which prevents the developer from leaking out of the developer container 7 from a gap between the support hole 762 of the support unit 76 and the connecting component 77.

Figure 6:
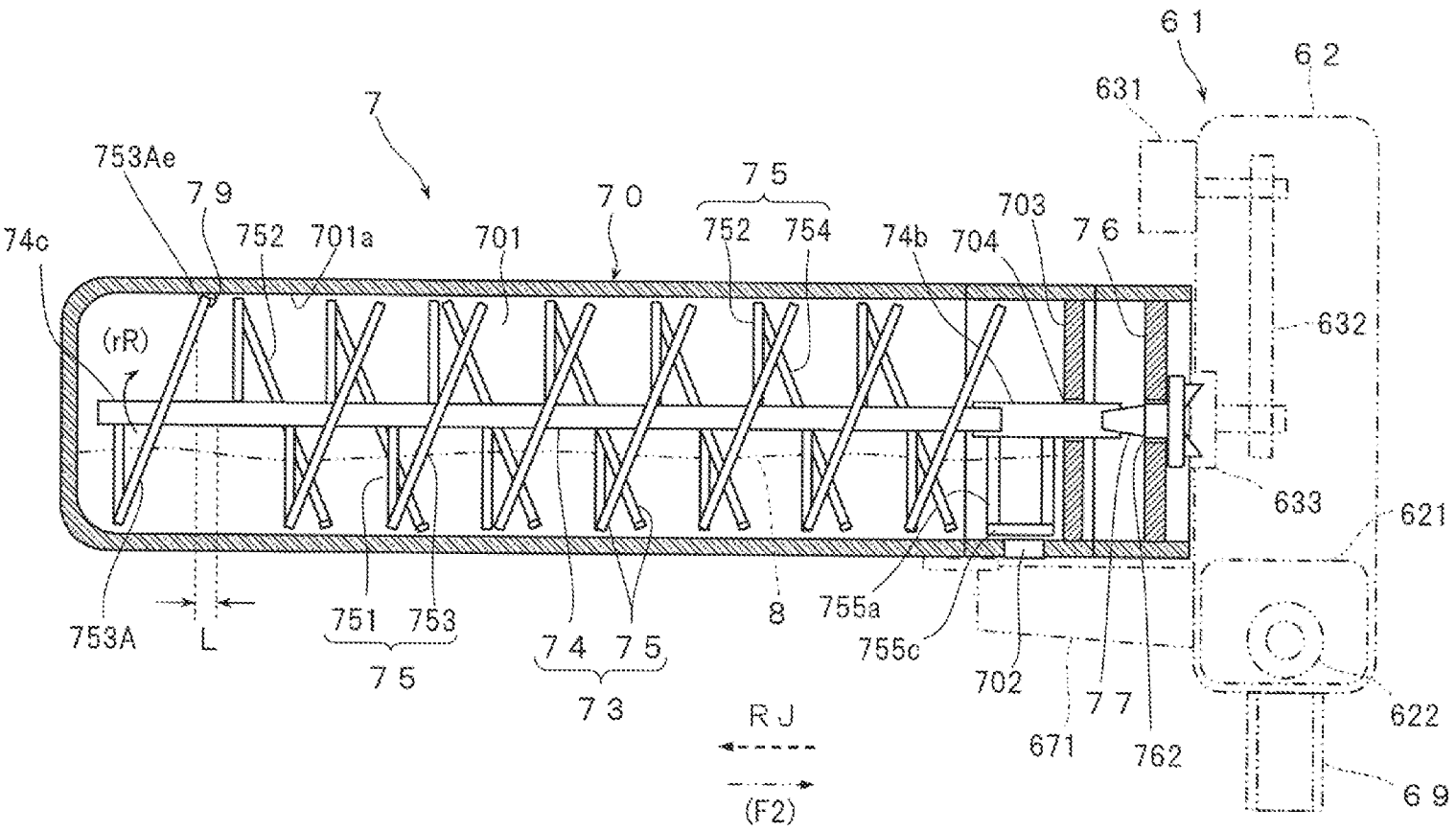
FIG. 6 is a schematic partial cross-sectional view illustrating a state of the developer container and the replenishing unit when the transport unit rotates in reverse.

Then, as illustrated in FIGS. 5 to 7, the developer container 7 is provided with a protrusion 79 which protrudes inward from the inner wall 701*a* of the accommodating space 701 of the container body 70. Further, when the transport unit 73 reversely rotates (rR) in the opposite direction to the rotational direction in transporting the developer 8, the transport blade 75 passes in contact with the protrusion 79 and also vibrates so as to touch the inner wall 701*a* of the accommodating space 701.

Of these, the protrusion 79 is a portion that causes vibrations in the transport blade 75 of the transport unit 73. The protrusion 79 is provided on a portion of the inner wall 701*a* which is above the surface of the developer 8 (the upper surface of the developer in the accommodated state) accommodated in the accommodating space 701 in the gravitational direction when the developer container 7 is used. The protrusion 79 according to the first exemplary embodiment is provided on substantially the uppermost portion of the inner wall 701*a* when the developer container 7 is mounted to the mounting portion of the image forming apparatus 1.

Further, the protrusion 79 is formed in a shape or a size in which the protrusion 79 serves to come into contact with a portion of the transport blade 75 and temporarily stop movement of the transport blade 75 when the transport unit 73 rotates in reverse. That is, the protrusion 79 may be formed in a shape or a size capable of exerting an action in which, when the transport unit 73 rotates reversely and a portion of the transport blade 75 passes in contact with the protrusion 79, at least the transport blade 75 vibrates, so that a portion of the transport blade 75 touch the inner wall 701 a of the accommodating space 701.

In addition, as illustrated in FIG. 5, since (the rotating shaft 74 of) the transport unit 73 is supported in a cantilever manner by the support unit 76, the protrusion 79 is provided in the area of the accommodating space 701 away from the support unit 76 in the longitudinal direction C. According to the first exemplary embodiment, the protrusion 79 is provided in the area between a first transport blade portion 753A of the transport blade 75 which is located farthest from the discharge port 702 and the second column portion 752 of the neighboring second transport blade portion 754.

Meanwhile, as illustrated in FIG. 5, the transport unit 73 is configured such that the transport blade 75 has a discontinuous shape having a gap L in the axial direction D at at least one location in the axial direction D of the rotating shaft 74. In the transport unit 73 according to the first exemplary embodiment, one location between a tip end 753Ae of the first transport blade portion 753A of the transport blade 75 which is located farthest from the discharge port 702 and the second column portion 752 of the neighboring second transport blade portion 754 is in a completely discontinuous state where the neighboring portions are not superimposed on each other in the axial direction D. The gap L of the completely discontinuous portion is a dimension necessary for the transport blade 75 of the transport unit 73 to pass without contact when the transport unit 73 stops and when the transport unit 73 rotates forward (pR).

At this time, the transport unit 73 is configured such that (i) when rotating forward (pR), the transport unit 73 comes to a state where the tip end 753Ae of the first transport blade portion 753A which is a completely discontinuous portion of the transport blade 75 passes without being in contact with the protrusion 79 (FIG. 5) and (ii) when rotating reversely (rR), the transport unit 73 comes to a state where the tip end 753Ae of the first transport blade portion 753A which is the completely discontinuous portion of the transport blade 75 is displaced so as to pass in contact with the protrusion 79 (FIG. 6).

The transport unit 73 according to the first exemplary embodiment is configured such that the end portion 74*b* of the rotating shaft 74 may be displaced (moved) toward the connecting component 77 when receiving an external force since the end portion 74*b* of the rotating shaft 74 has a slight gap (backlash) in the axial direction D on the joint portion with the connecting component 77 as described above.

Specifically, for example, the end portion 74*b* of the rotating shaft 74 has a hollow structure in a side portion thereof connected to the connecting component 77, and also has a structure in which a claw (projection) is provided along the axial direction D on the hollow inner wall surface. Meanwhile, a side portion of the connecting component 77 which is connected to the rotating shaft 74 is formed as a shaft portion which is inserted into the hollow portion of the end portion 74*b*, and also has a structure in which a groove into which the claw is fitted is provided in the peripheral surface of the shaft portion to extend a required length along the axial direction D. Thus, the transport unit 73 is configured such that the shaft portion of the connecting component 77 is inserted into the hollow portion of the end portion 74*b* of the rotating shaft 74 and the claw is fitted into the groove, so that both the claw and the groove are fixed in the circumferential direction (rotational direction), but the claw may be slightly moved in the axial direction D in the groove. As a result, the transport unit 73 is configured such that the end portion 74*b* of the rotating shaft 74 may be slightly displaced in the axial direction D on the joint portion with the connecting component 77.

For this reason, as illustrated in FIG. 6, when the transport unit 73 rotates reversely (rR), the transport blade 75 is integrated with the rotating shaft 74 and is displaced toward the back side where the discharge port 702 is located by receiving a reaction force F2 from the developer 8 which is generated when the transport blade 75 transports the developer 8 in a direction RJ opposite to a normal transport direction J. At this time, the connecting component 77 is not particularly displaced.

Configuration Related to Developer Container of Image Forming Apparatus

Figure 8A:
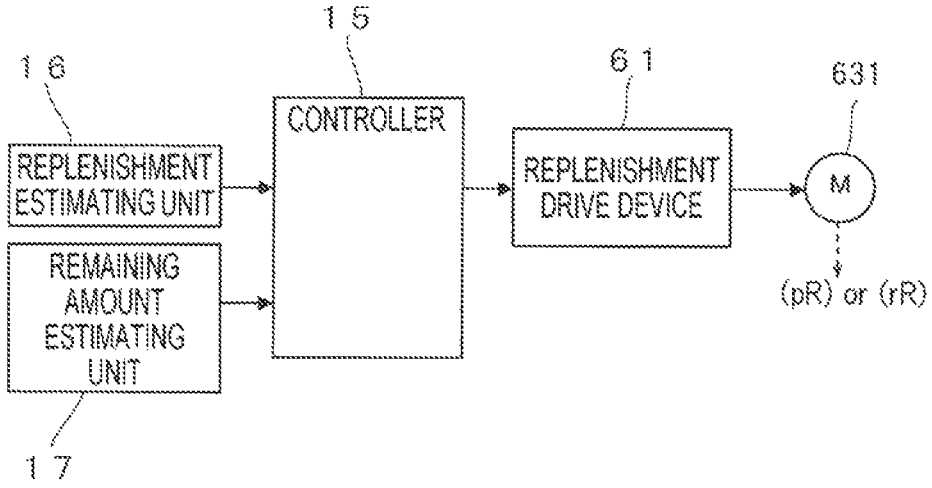
FIG. 8A is a block diagram illustrating a control configuration related to the replenishing unit of the image forming apparatus.

Further, as illustrated in FIGS. 5, 6 and 8A, the image forming apparatus 1 is configured such that the rotational drive device 63 which is an example of a rotational drive unit of the replenishment drive device 61 of the replenishing unit 6 is able to switch the transport unit 73 of the developer container 7 between the forward rotation (pR) and the reverse rotation (rR). The image forming apparatus 1 has a timing of performing an operation of reversely rotating the transport unit 73 of the developer container 7 by the rotational drive device 63.

In the image forming apparatus 1 according to the first exemplary embodiment, as illustrated in FIG. 8A, an operation of the replenishment drive device 61 is controlled by the controller 15, and specifically, the amount of rotation or the direction of rotation of the electric motor 631 which is a power source of the rotational drive device 63 of the replenishment drive device 61 is controlled by the controller 15. The controller 15 is configured with, for example, a microcomputer and is adapted to operate based on a control program or data stored in a storage unit.

Further, as illustrated in FIG. 8A, the image forming apparatus 1 includes a replenishment estimating unit 16 which estimates the replenishment amount of the developer by measuring the state of the developer such as a toner concentration in the developing device 24 and a remaining amount estimating unit 17 which estimates the remaining amount of the developer 8 accommodated in the developer container 7.

The replenishment estimating unit 16 measures the toner concentration of the developer in the accommodating chamber of the case 240 of the developing device 24 with a measuring unit such as a toner concentration sensor, and estimates and calculates the replenishment amount of the developer from the measured information. The remaining amount estimating unit 17 estimates, for example, the remaining amount of the developer from information on the initial capacity of the developer container 7 and the integrated amount of the developer supplied from the replenishment estimating unit 16. The replenishment estimating unit 16 and the remaining amount estimating unit 17 are connected to the controller 15 and transmit the estimated information thereof to the controller 15.

Figure 8B:
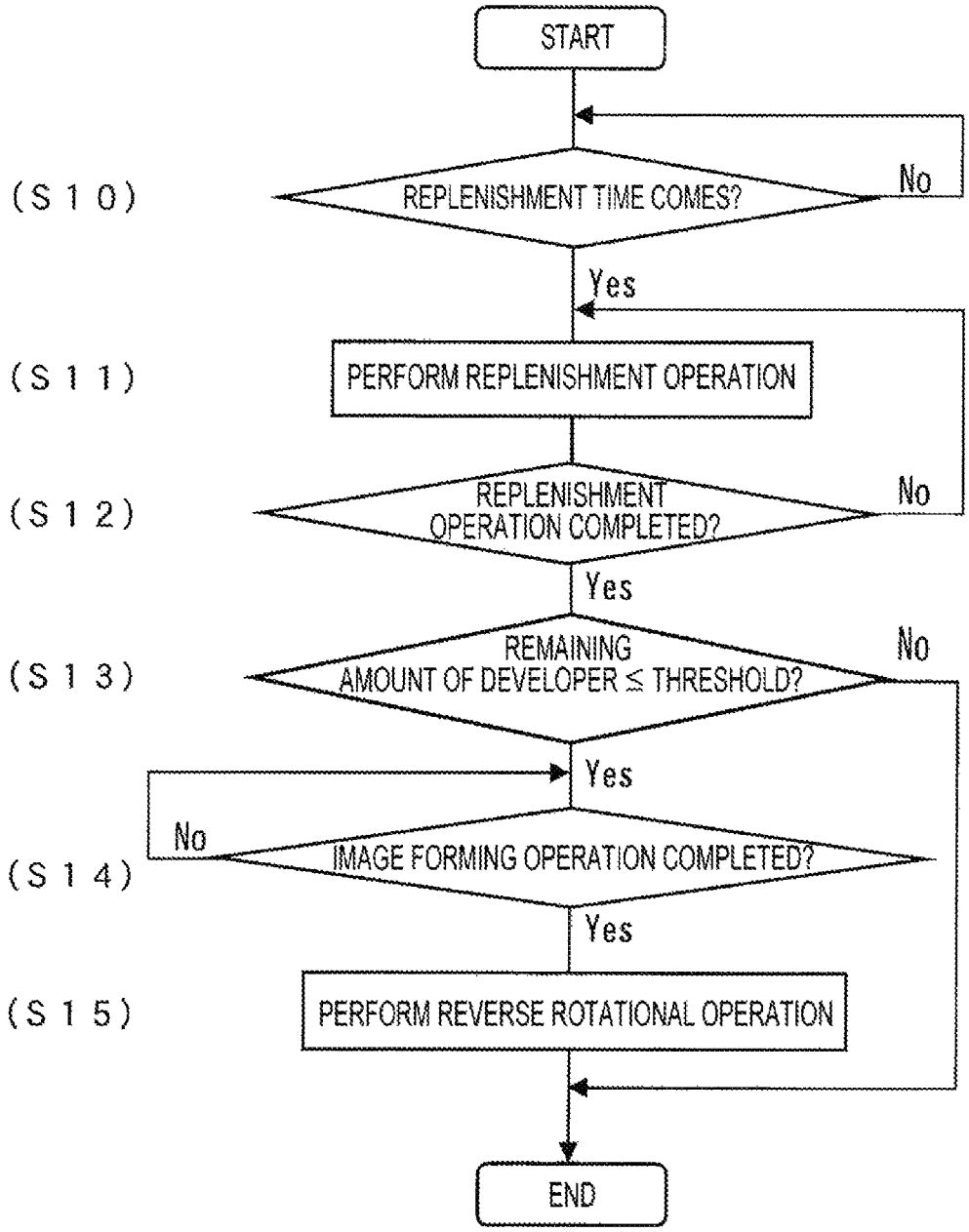
FIG. 8B is a flowchart illustrating an example of an operation of the replenishing unit.

In addition, the image forming apparatus 1 regards that the replenishment time has arrived when the replenishment amount of the developer estimated by the replenishment estimating unit 16 is equal to or greater than a predetermined replenishment amount of the developer, and the controller 15 performs control to drive the replenishment drive device 61 for a required time (FIG. 8B). Further, the image forming apparatus 1 is configured such that the controller 15 executes an operation of rotating the rotational drive device 63 of the replenishment drive device 61 in reverse by a predetermined amount when the remaining amount of the developer 8 estimated by the remaining amount estimating unit 17 is equal to or less than a predetermined threshold (FIG. 8B).

As for the threshold of the remaining amount of the developer 8, the remaining amount of the developer 8 is set to a value of 50% or less with respect to the initial capacity of the developer container 7, and more preferably, the remaining amount of the developer 8 is set to a value within the range of 30% or more and 50% or less.

Mounting and Operation of Developer Container

Then, in the replenishing unit 6, as illustrated in FIG. 2, when the developer container 7 is mounted and is held by the container holding unit 67, the connecting component 77 of the developer container 7 is coupled to the connecting member 633 of the rotational drive device 63 of the replenishment drive device 61.

Thus, the transport unit 73 of the developer container 7 comes to a state where it may be driven upon receiving rotational power from the rotational drive device 63 of the replenishment drive device 61.

Further, in the image forming apparatus 1 equipped with the developer container 7, the replenishing unit 6 operates as follows.

First, in the replenishing unit 6, as illustrated in FIG. 8B, when the controller 15 determines that the replenishment time has come based on information input from the replenishment estimating unit 16 (step 10: S10), a replenishment operation is performed (SI 1).

The replenishment operation at this time is performed in such a manner that the electric motor 631 of the rotational drive device 63 of the replenishment drive device 61 rotates forward (pR) for a required time and the rotational power thereof is transmitted to the delivery member 622 via the driving transmission mechanism 632, whereby the delivery member 622 is driven to send the developer 8 in the accommodating and transport unit 621 of the housing 62 toward the transport pipe 69 by a predetermined amount. Thus, the developer 8 in the developer container 7 is sent to and replenished in the accommodating chamber of the case 240 of the developing device 24 through the transport pipe 69. When the developer container 7 is initially mounted, the accommodating and transport unit 621 is filled with the developer 8 via the implementation of an operation of discharging the developer 8 in the developer container 7 to the accommodating and transport unit 621 by a predetermined amount as an initial operation.

Further, at this time, in the replenishing unit 6, when the electric motor 631 of the replenishment drive device 61 rotates forward (pR) for a predetermined time, the rotational power thereof is transmitted to the rotating shaft 74 of the transport unit 73 of the developer container 7 via the driving transmission mechanism 632, the connecting member 633, and the connecting component 77, and the transport unit 73 rotates forward (pR).

Thus, in the developer container 7, as illustrated in FIG. 5, the developer 8 in the accommodating space 701 is transported toward the discharge port 702 in the direction indicated by the arrow J by the transport unit 73 which rotates forward (pR), and is discharged from the discharge port 702 into the accommodating and transport unit 621 of the housing 62 to fill the accommodating and transport unit 621.

Additionally, at this time, as illustrated in FIG. 5, since a completely discontinuous portion of the transport unit 73 passes the protrusion 79 and the first transport blade portion 753A present on the side of the completely discontinuous portion rotates without contact with the protrusion 79, there occurs no generation of abnormal noise caused when the transport blade 75 of the transport unit 73 passes in contact with the protrusion 79 or aggregation of the developer 8 during an operation of transporting the developer 8 toward the discharge port 702.

Further, at this time, the transport unit 73 receives a reaction force in the direction indicated by the arrow F1 from the developer 8 that is being transported, but is not displaced in the direction indicated by the arrow F1 since the claw located in the hollow connection portion of the end portion 74*b* of the rotating shaft 74 according to the first exemplary embodiment comes into contact with the end of the shaft portion of the connecting component 77 on the tip end side of the groove, so that a further movement of the transport unit 73 is restricted.

Subsequently, in the replenishing unit 6, as illustrated in FIG. 8B, when the controller 15 determines that the replenishment operation has been completed (S12), it is determined whether the remaining amount of the developer 8 inside the developer container 7 estimated by the remaining amount estimating unit 17 is equal to or less than a threshold (S13). The threshold at this time is set to, for example, 40%.

When it is determined in step 13 that the remaining amount of the developer 8 in the developer container 7 is not equal to or less than the threshold, it is regarded that the developer 8 is provided in a sufficient amount in the developer container 7, and the operation of the replenishing unit 6 is completed.

Meanwhile, when it is determined that the remaining amount of the developer 8 in the developer container 7 is equal to or less than the threshold, it is determined whether an image forming operation has been completed (S14). Thus, a reverse rotational operation is not performed during the image forming operation.

Then, when it is determined in step 14 that the image forming operation has been completed, a reverse rotational operation is performed (S15).

In the reverse rotational operation at this time, the electric motor 631 of the rotational drive device 63 of the replenishment drive device 61 rotates reversely (rR) for a predetermined time, the rotational power thereof is transmitted to the rotating shaft 74 of the transport unit 73 of the developer container 7 via the driving transmission mechanism 632, the connecting member 633, and the connecting component 77, and the transport unit 73 rotates reversely (rR). In the first exemplary embodiment, the transport unit 73 rotates reversely (rR) so as to rotate two or three times in the accommodating space 701.

Thus, in the developer container 7, as illustrated in FIG. 6, the developer 8 in the accommodating space 701 is temporarily transported in the direction indicated by the arrow RJ away from the discharge port 702 by the transport unit 73 which rotates reversely (rR). Moreover, since (the transport blade 75 of) the transport unit 73 receives a reaction force in the direction indicated by the arrow F2 from the developer 8 that is being transported, the end portion 74*b* of the rotating shaft 74 of the transport unit 73 is engaged with the displaceable structure described above, so that the rotating shaft 74 of the transport unit 73 is displaced in the direction of the reaction force F2.

As a result, in the developer container 7, as illustrated in FIG. 6 or FIG. 7, the tip end 753Ae of the first transport blade portion 753A which is located farthest from the discharge port 702 of the transport unit 73 passes in contact with the protrusion 79.

Further, at this time, in the developer container 7, when the tip end 753Ae of the first transport blade portion 753A of the transport unit 73 comes into contact with the protrusion 79, the movement of the first transport blade portion 753A is temporarily blocked (caught). Therefore, a portion of the rotating shaft 74, which is supported in a cantilever manner, including an end portion 74*c* on the unfixed side is elastically deformed so as to temporarily bend under the influence of the above-described state of the first transport blade portion 753A. Moreover, the deformed portion of the rotating shaft 74 moves so as to be restored at a place where the tip end 753Ae of the first transport blade portion 753A passes over the protrusion 79.

As a result, in the developer container 7, as illustrated in FIG. 7, the transport unit 73 including the transport blade 75 as well as the rotating shaft 74 vibrates so as to reciprocate in the accommodating space 701 in the direction indicated by, for example, the double-sided arrow Vb. Further, at this time, the transport unit 73 vibrates while a part or the entirety of the transport blade 75 including the first transport blade portion 753A touches the inner wall 701*a* of the accommodating space 701 so as to collide therewith.

Thus, in the developer container 7, since the transport unit 73 applies vibration to the container body 70 to vibrate the container body 70 when the reverse rotational operation is performed, a developer 8*x* which is not scraped off by the transport unit 73 and is adhered to the inner wall 701*a* of the accommodating space 701 is peeled off from the inner wall 701*a*. Therefore, in the developer container 7, since the developer 8*x* adhered to the inner wall 701*a* of the container drops and is reduced by the implementation of the reverse rotational operation, the remaining amount of the developer 8 is reduced at the time of replacement of the developer container 7.

Further, in the image forming apparatus 1, since the reverse rotational operation is performed at the time point at which the remaining amount of the developer 8 in the developer container 7 becomes 40% or less, as illustrated in FIG. 6 or FIG. 7, it is possible to efficiently vibrate the transport unit 73 and to reliably vibrate the container body 70 while the remaining amount of the developer 8 is low. As a result, the developer 8*x* adhered to the inner wall 701*a* of the developer container 7 reliably drops. Further, in the image forming apparatus 1, by dropping the developer 8*x* adhered to the inner wall 701*a* of the developer container 7 to reduce the remaining amount of the developer, compared to a case where the remaining amount of the developer in the developer container 7 cannot be reduced as in the first exemplary embodiment, the number of images to be formed and the number of pages increase as the remaining amount of the developer decreases.

In addition, in the image forming apparatus 1, since that the transport unit 73 performs the reverse rotational operation so as to rotate two or three times in the accommodating space 701, there is no risk that another member such as the delivery member 622 which is driven upon receiving the rotational power from the rotational drive device 63 of the replenishment drive device 61 during the reverse rotational operation is rotated unnecessarily much in reverse despite that such reverse rotation is originally unnecessary, thus disturbing the replenishment operation of the developer 8 by the replenishing unit 6.

Further, with the reverse rotational operation, even if the transport unit 73 is set to rotate once in the accommodating space 701, the developer 8*x* adhered to the inner wall 701*a* of the developer container 7 drops as long as the transport unit 73 sufficiently vibrates to sufficiently vibrate the container body 70 when the transport unit 73 passes in contact with the protrusion 79.

Second Exemplary Embodiment

Figure 9:
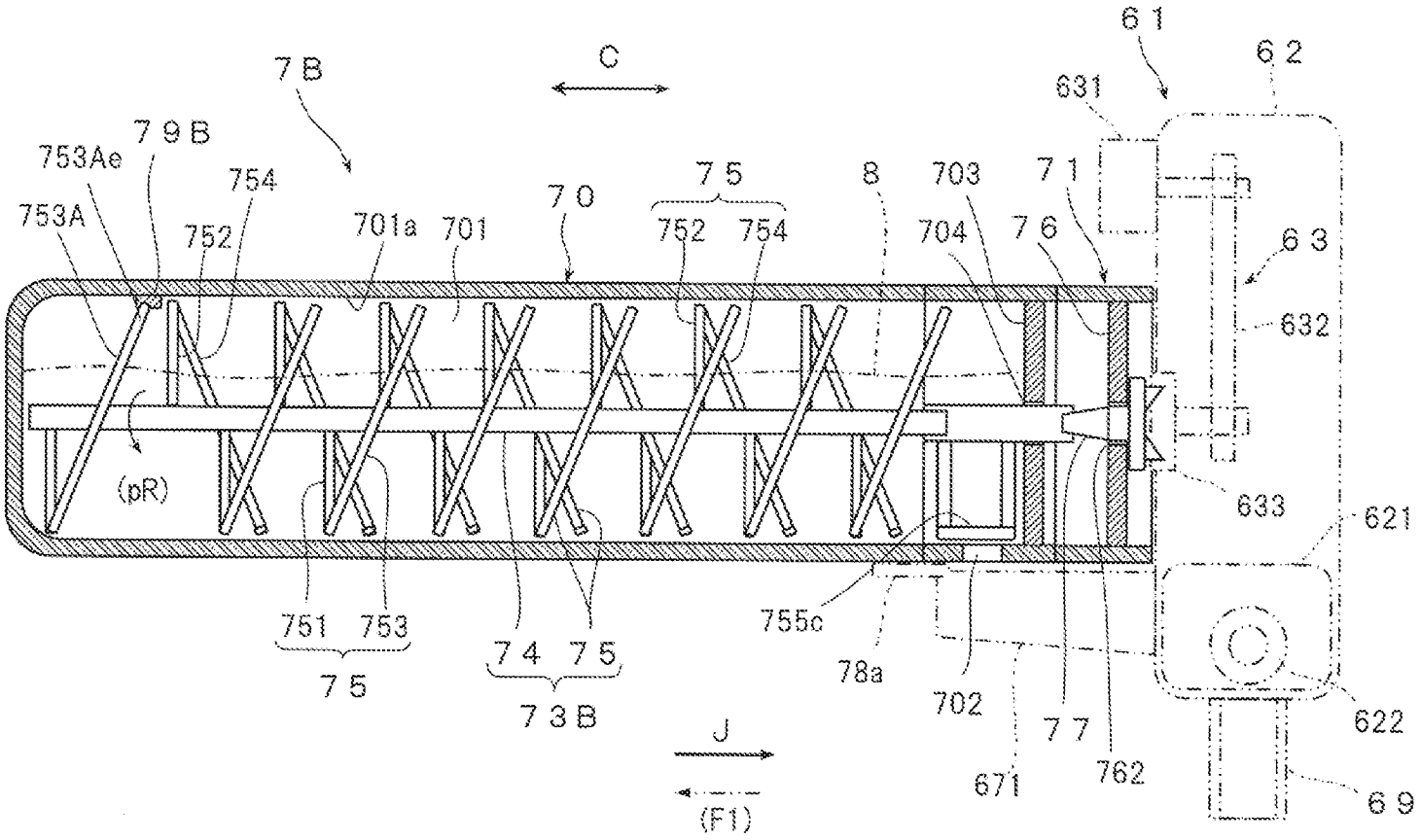
FIG. 9 is a schematic partial cross-sectional view illustrating a state of a developer container and a replenishing unit according to a second exemplary embodiment.
Figure 10A:
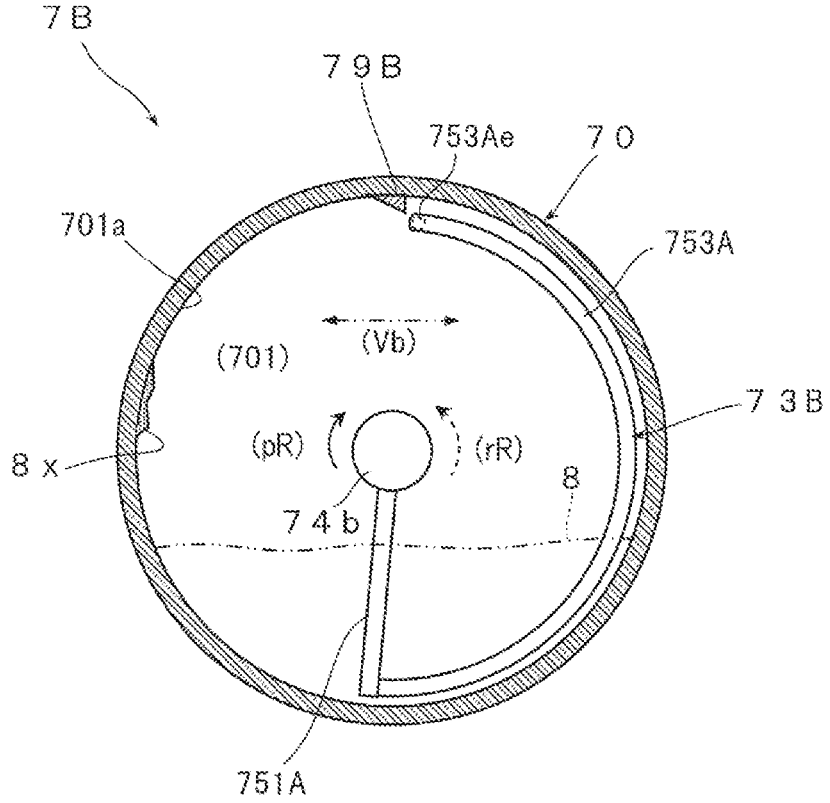
FIG. 10A is a schematic partial cross-sectional view illustrating a configuration of the developer container of FIG. 9.
Figure 10B:
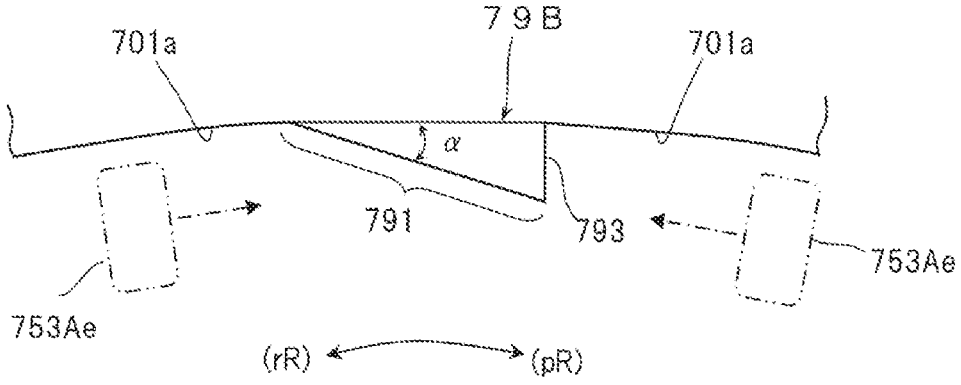
FIG. 10B is an enlarged schematic view illustrating a configuration of a protrusion in the developer container of FIG. 10A.

FIGS. 9, 10A and 10B illustrate a portion of a developer container 7B according to a second exemplary embodiment.

The developer container 7B according to the second exemplary embodiment has the same configuration as the developer container 7 according to the first exemplary embodiment except that a protrusion 79B having the following different configuration is applied in place of the protrusion 79 and that a transport unit 73B configured to bring a (second) portion of the transport blade 75 into contact with the protrusion 79B even in forward rotation (pR) is applied in place of the transport unit 73.

First, as illustrated in FIG. 9, the transport unit 73B of the developer container 7B is changed in the angle or the length when the tip end 753Ae of the first transport blade portion 753A of the transport blade 75 is spirally bent so as to come into contact with the protrusion 79B, but the other configuration is the same as that of the transport unit 73 according to the first exemplary embodiment. The transport blade 75 of the transport unit 73B has a completely discontinuous shape between the first transport blade portion 753A and the neighboring second transport blade portion 754.

Next, as illustrated in the enlarged view of FIG. 10B, the protrusion 79B of the developer container 7B is configured in a shape having a gently inclined surface portion 791 which keeps the transport blade 75 so as not to touch the inner wall 701*a* of the accommodating space 701 when the transport unit 73B rotates forward (pR) and the tip end 753Ae of the first transport blade portion 753A of the transport blade 75 passes in contact with the protrusion 79B, and a vibration inducing surface portion 793 which vibrates the transport blade 75 so as to touch the inner wall 701*a* of the accommodating space 701 when the transport unit 73B rotates reversely (rR) and the tip end 753Ae of the first transport blade portion 753A passes in contact with the protrusion 79B.

The gently inclined surface portion 791 of the protrusion 79B is a surface that gradually shifts inward of the accommodating space 701 as the inclined surface moves downstream in the direction in which the transport unit 73B rotates forward (pR). The inclined surface of the gently inclined surface portion 791 may keep the first transport blade portion 753A of the transport blade 75 so as not to touch the inner wall 701*a* of the accommodating space 701 when passing in contact with the gently inclined surface portion 791 in forward rotation (pR). For example, the inclination angle $\alpha$ of the inclined surface with respect to the inner wall 701*a* of the accommodating space 701 has a value within the range of 20° to 45°.

Further, the vibration inducing surface portion 793 of the protrusion 79B is a surface that may greatly vibrate the first transport blade portion 753A and the like when the tip end 753Ae of the first transport blade portion 753A of the transport blade 75 of the transport unit 73B passes in contact with the protrusion 79B in reverse rotation (rR). The vibration inducing surface portion 793 includes, for example, a vertical surface that extends substantially perpendicular to the inner wall 701*a* of the accommodating space 701. The vibration inducing surface portion 793 may include a surface having any other shape as long as it may temporarily prevent movement of the first transport blade portion 753A when the tip end 753Ae of the first transport blade portion 753A of the transport blade 75 of the transport unit 73B comes into contact with the vibration inducing surface portion 793 in reverse rotation (rR).

As illustrated in FIGS. 10A and 10B, the protrusion 79B according to the second exemplary embodiment includes a protrusion the cross section of which has a substantially right triangular shape when the protrusion is cut along a plane perpendicular to the longitudinal direction of the container body 70.

Further, in a case where the protrusion 79B is provided, the developer container 7B is not necessarily configured such that the transport unit 73B is displaced when the transport unit 73B rotates reversely (rR). Further, according to the second exemplary embodiment, for example, in a case where the transport unit 73B has a shape such that an intermediate portion of the first transport blade portion 753A of the transport blade 75 comes into contact with the protrusion 79B, the transport unit 73B does not need to have a completely discontinuous shape.

Then, as illustrated in FIG. 9, when the replenishment operation is performed by forward rotation (pR) of the transport unit 73B of the replenishing unit 6 after the developer container 7B is mounted to the mounting portion of the image forming apparatus 1, the tip end 753Ae of the first transport blade portion 753A of the transport blade 75 of the transport unit 73B passes in contact with the protrusion 79B.

At this time, as illustrated in FIG. 10B, since the tip end 753Ae of the first transport blade portion 753A moves so as to pass in contact with the gently inclined surface portion 791 of the protrusion 79B, the movement of the transport unit 73B is hardly blocked temporarily, and the rotating shaft 74 is not greatly elastically deformed after the passage of the tip end 753Ae. As a result, there occurs no great vibration.

Therefore, in the developer container 7B, when the transport unit 73B rotates forward (pR) and the tip end 753Ae of the first transport blade portion 753A of the transport blade 75 of the transport unit 73B passes in contact with the protrusion 79B, the first transport blade portion 753A does not vibrate so as to touch the inner wall 701*a* of the accommodating space 701 and moves while being kept so as not to touch the inner wall 701*a*.

Meanwhile, in the developer container 7B, when the reverse rotational operation is performed by reverse rotation (rR) of the transport unit 73B of the replenishing unit 6, the tip end 753Ae of the first transport blade portion 753A of the transport blade 75 of the transport unit 73B passes in contact with the protrusion 79B from the direction opposite to that in forward rotation (pR).

At this time, as illustrated in FIG. 10B, since the tip end 753Ae of the first transport blade portion 753A passes in contact with the vibration inducing surface portion 793 of the protrusion 79B, the movement of the transport unit 73B is temporarily blocked, and a portion of the rotating shaft 74 including the unfixed end portion 74*c* is elastically deformed under the influence of the temporary movement blocking of the first transport blade portion 753A after the passage of the tip end 753Ae.

As a result, as illustrated in FIG. 10A, the transport unit 73B vibrates so as to reciprocate in the accommodating space 701 in the direction as indicated by, for example, the double-sided arrow Vb in conjunction with movement such as restoration of the elastically deformed portion of the rotating shaft 74. Further, at this time, the transport unit 73B vibrates while a part or the entirety of the transport blade 75 including the first transport blade portion 753A touch the inner wall 701*a* of the accommodating space 701 so as to collide with the inner wall 701*a*.

Thus, in the developer container 7B, similarly, since the transport unit 73B applies vibration to the container body 70 to vibrate the container body 70 when the reverse rotational operation is performed, substantially in the same manner as the developer container 7 according to the first exemplary embodiment, the developer 8*x* which is not scraped off by the transport unit 73B and is adhered to the inner wall 701*a* of the accommodating space 701 is peeled off from the inner wall 701*a*. Therefore, in the developer container 7B, similarly, since the developer 8*x* adhered to the inner wall 701 a of the container drops and is reduced by the implementation of the reverse rotational operation, the remaining amount of the developer 8 is reduced at the time of replacement of the developer container 7B.

Third Exemplary Embodiment

FIG. 1I illustrates a portion of a developer container 7C according to a third exemplary embodiment.

The developer container 7C according to the third exemplary embodiment has the same configuration as that of the developer container 7B according to the second exemplary embodiment except that the protrusion 79 according to the first exemplary embodiment is applied in place of the protrusion 79B and that a transport unit 73C in which a portion of the transport blade 75 has a different configuration is applied in place of the transport unit 73B.

Figure 12A:
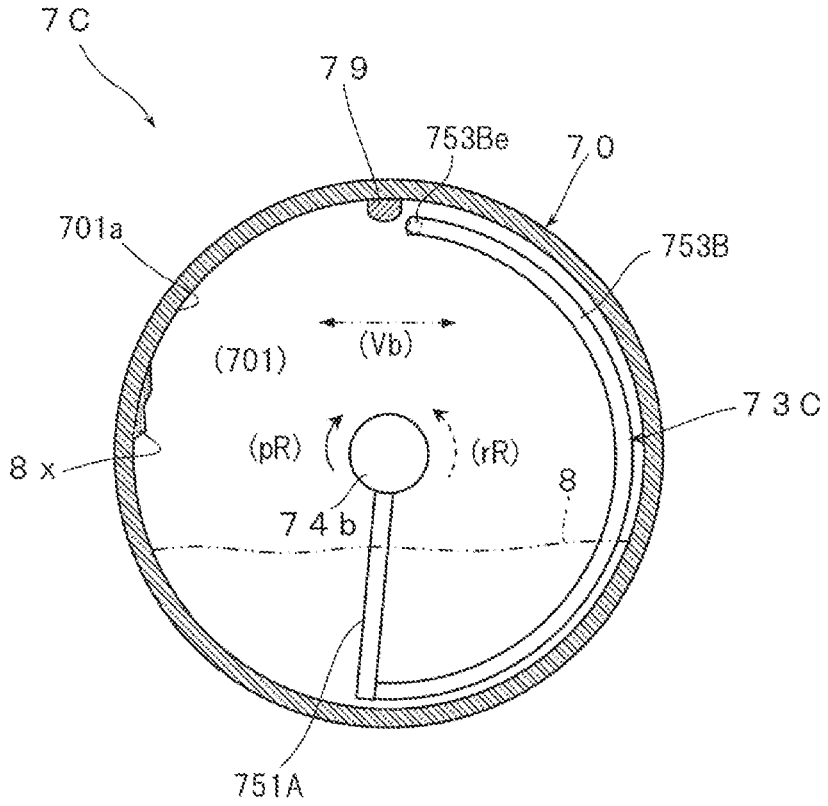
FIG. 12A is a schematic partial cross-sectional view illustrating a configuration of the developer container of FIG. 11.
Figure 12B:
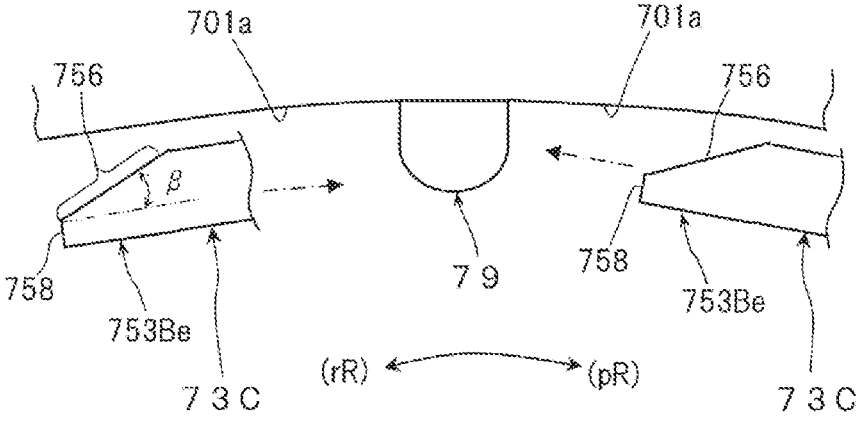
FIG. 12B is an enlarged schematic view illustrating a configuration of a transport blade of a transport unit in the developer container of FIG. 12A.

As illustrated in FIG. 12B, the transport unit 73C of the developer container 7C is configured to provide a first transport blade portion 753B which comes into contact with the protrusion 79 at the farthest position from the discharge port 702 with a portion (tip end 753Be) formed in a shape having a gently inclined surface portion 756 which is kept so as not to touch the inner wall 701*a* of the accommodating space 701 when passing in contact with the protrusion 79 in forward rotation (pR) of the transport unit 73C and a vibration inducing surface portion 758 which vibrates the first transport blade portion 753B so as to touch the inner wall 701*a* of the accommodating space 701 when passing in contact with the protrusion 79 in reverse rotation (rR) of the transport unit 73C. That is, the transport unit 73C has the same configuration as the transport unit 73B according to the second exemplary embodiment except that the configuration of the first transport blade portion 753B is partially changed as described above.

The gently inclined surface portion 756 of the first transport blade portion 753B of the transport unit 73C is a surface of the tip end 753Be of the first transport blade portion 753B which gradually approaches the inner wall 701*a* of the accommodating space 701 as the inclined surface thereof moves upstream in the direction in which the transport unit 73C rotates forward (pR). The inclined surface of the gently inclined surface portion 756 may be kept so as not to touch the inner wall 701*a* of the accommodating space 701 when passing in contact with the protrusion 79 in forward rotation (pR). For example, the inclination angle β of the inclined surface with respect to an outer surface close to the tip end 753Be of the first transport blade portion 753B has a value within the range of 30° to 60°.

Further, the vibration inducing surface portion 758 of the first transport blade portion 753B of the transport unit 73C is a surface that may greatly vibrate the first transport blade portion 753B and the like when the transport unit 73C rotates reversely (rR) and the first transport blade portion 753B passes in contact with the protrusion 79. The vibration inducing surface portion 758 includes, for example, a vertical end surface that intersects with the outer surface close to the tip end 753Be of the first transport blade portion 753B at a substantially right angle. The vibration inducing surface portion 758 may be configured as a surface having any other shape as long as it may temporarily prevent movement of the first transport blade portion 753B of the transport unit 73C when the transport unit 73C rotates reversely (rR) and the tip end 753Be contacts the protrusion 79.

As illustrated in FIG. 12B, the tip end 753Be of the first transport blade portion 753B of the transport unit 73C according to the second exemplary embodiment includes a tip end having a tapered shape in which a portion close to the inner wall 701 a of the container body 70 has an inclined surface.

Further, when the transport unit 73C is applied, the developer container 7C is not necessarily configured such that the transport unit 73C is displaced in reverse rotation (rR) of the transporting unit 73C. Further, according to the third exemplary embodiment, similarly, for example, in a case where the transport unit 73C has a shape such that an intermediate portion of the first transport blade portion 753B of the transport blade 75 has the gently inclined surface portion 756 and the vibration inducing surface portion 758, the transport unit 73C does not need to have a completely discontinuous shape.

Figure 11:
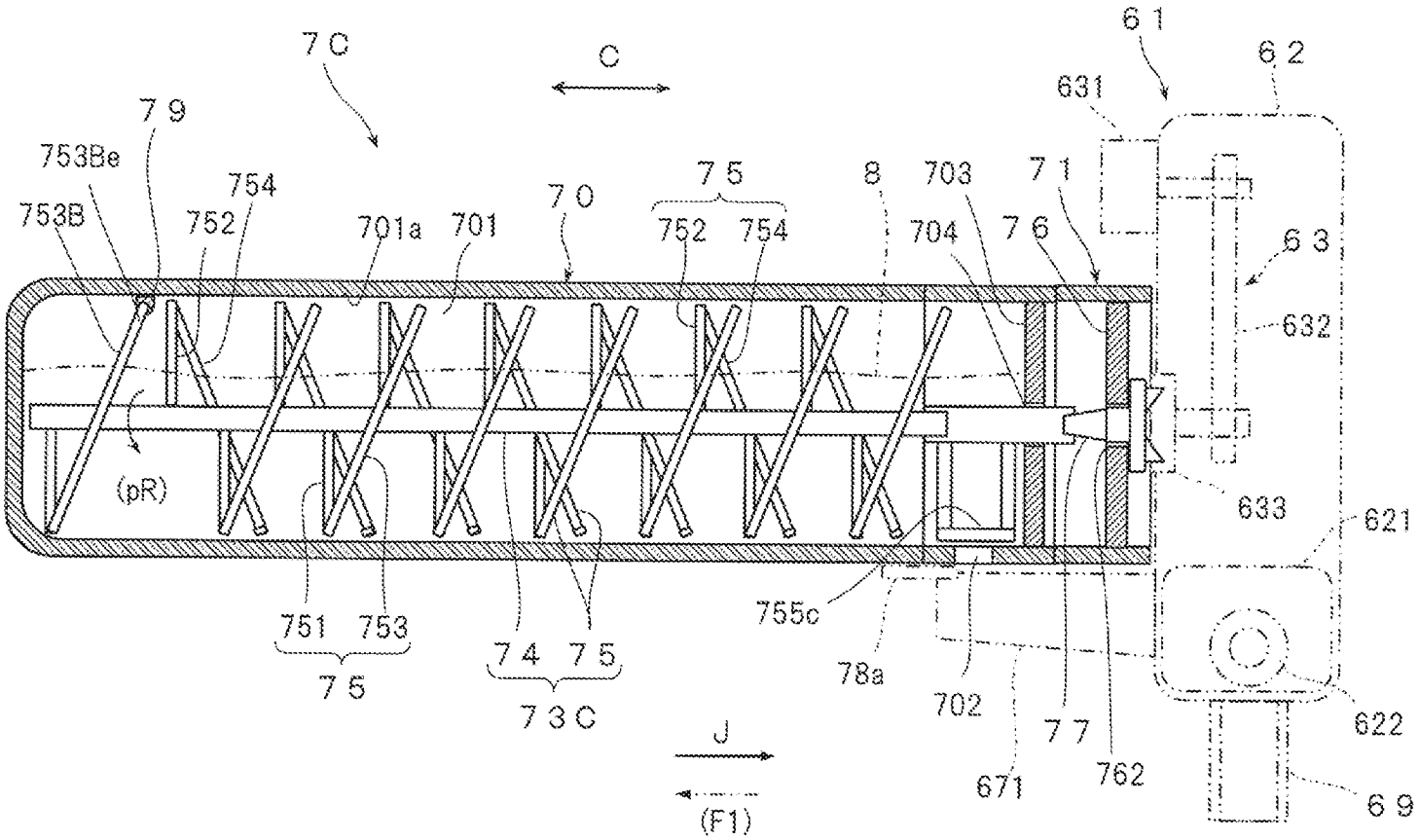
FIG. 11 is a schematic partial cross-sectional view illustrating a state of a developer container and a replenishing unit according to a third exemplary embodiment.

Then, as illustrated in FIG. 11, when the replenishment operation is performed by forward rotation (pR) of the transport unit 73C of the replenishing unit 6 after the developer container 7C is mounted to the mounting portion of the image forming apparatus 1, the tip end 753Be of the first transport blade portion 753B of the transport blade 75 of the transport unit 73C passes in contact with the protrusion 79.

At this time, in the transport unit 73C, as illustrated in FIG. 12B, since the gently inclined surface portion 756 of the tip end 753Be of the first transport blade portion 753B finally moves so as to pass in contact with the protrusion 79, the movement of the first transport blade portion 753B is hardly blocked temporarily, and the rotating shaft 74 is not greatly elastically deformed after the passage of the tip end 753Be. As a result, there occurs no great vibration.

Therefore, in the developer container 7C, when the transport unit 73C rotates forward (pR) and the tip end 753Be of the first transport blade portion 753B of the transport unit 73C passes in contact with the protrusion 79, the first transport blade portion 753B does not vibrate so as to touch the inner wall 701*a* of the accommodating space 701 and moves while being kept so as not to touch the inner wall 701*a*.

Meanwhile, in the developer container 7C, when the reverse rotational operation is performed by reverse rotation (rR) of the transport unit 73C of the replenishing unit 6, the tip end 753Be of the first transport blade portion 753B of the transport blade 75 of the transport unit 73C passes in contact with the protrusion 79 from the direction opposite to that in forward rotation (pR).

At this time, in the transport unit 73C, as illustrated in FIG. 12B, since the vibration inducing surface portion 758 of the tip end 753Be of the first transport blade portion 753B moves so as to pass after contacting the protrusion 79 so as to collide with the protrusion 79, the movement of the first transport blade portion 753B is temporarily blocked, and a portion of the rotating shaft 74 including the unfixed end portion 74*c* is elastically deformed under the influence of the temporary movement blocking of the first transport blade portion 753B after the passage.

As a result, as illustrated in FIG. 12A, the transport unit 73C vibrates so as to reciprocate in the accommodating space 701 in the direction as indicated by, for example, the double-sided arrow Vb in conjunction with movement such as restoration of the elastically deformed portion of the rotating shaft 74. Further, at this time, the transport unit 73C vibrates while a part or the entirety of the transport blade 75 including the first transport blade portion 753B touch the inner wall 701*a* of the accommodating space 701 so as to collide with the inner wall 701*a*.

Thus, even in the developer container 7C, since the transport unit 73C applies vibration to the container body 70 to vibrate the container body 70 when the reverse rotational operation is performed, substantially in the same manner as the developer container 7B according to the second exemplary embodiment, the developer 8*x* which is not scraped off by the transport unit 73C and is adhered to the inner wall 701*a* of the accommodating space 701 is peeled off from the inner wall 701 a. Therefore, even in the developer container 7C, since the developer 8*x* adhered to the inner wall 701*a* of the container drops and is reduced by the implementation of the reverse rotational operation, the remaining amount of the developer 8 is reduced at the time of replacement of the developer container 7C.

Modification

The present disclosure is not limited to the content exemplified in the first to third exemplary embodiments, and various modifications may be made without departing from the gist of each disclosure recited in each claim. For this reason, the present disclosure includes modifications as exemplified below.

In the developer containers 7, 7B and 7C according to the first to third exemplary embodiments, a configuration example in which one protrusion 79 or 79B is provided is illustrated, but the developer container may be configured such that multiple (for example, two to four) protrusions 79 are provided. In a case where the developer container 7 according to the first exemplary embodiment is provided with multiple protrusions 79, a completely discontinuous portion of the transport unit 73 may be formed in the same number as that of the protrusions 79.

In the developer containers 7, 7B, and 7C according to the first to third exemplary embodiments, a configuration example in which the rotating shaft 74 of the transport units 73, 73B and 73C is supported in a cantilever manner is illustrated, but the developer container may be configured such that both ends of the rotating shaft 74 are supported in a bridge state. In this case, the protrusion 79 or 79B may be provided, for example, on a portion near the center of the container body 70 in the longitudinal direction C.

Further, in the first to third exemplary embodiments, since the rotating shaft 74 is elastically deformed when the transport units 73, 73B or 73C of the developer container 7, 7B or 7C is rotated in reverse so that the transport blade 75 passes in contact with the protrusion 79 or 79B, the transport unit 73 including the transport blade 75 vibrates thereby vibrating the container body 70.

However, in the first to third exemplary embodiments, since the rotating shaft 74 of any one developer container 7, 7B or 7C is supported in a cantilever manner and receives rotational power from one side via the connecting component 77, tooth skipping may occur due to an increase in the load of the connecting component 77 or the driving transmission mechanism 632 of the rotation drive device 63 when a reverse rotation operation is performed.

For this reason, in the developer containers 7, 7B. 7C in which such tooth skipping may occur, the transport units 73, 73B and 73C may vibrate due to the tooth skipping, and consequently, the container body 70 may also vibrate.

Even in this case, when the container body 70 vibrates, the developer 8*x* adhered to the inner wall of each developer container 7, 7B, or 7C drops, and the remaining amount of the developer 8 is reduced at the time of each replacement.

Further, according to the first exemplary embodiment, as a structure in which the transport unit 73 may be slightly displaced in the axial direction D, for example, the end portion 74*b* of the rotating shaft 74 and the connecting component 77 are substantially integrally connected to each other without a displacement in the axial direction D, but a structure in which the connecting component 77 may be displaced toward the connecting member 633 of the replenishment drive device 61 when the transport unit 73 is rotated in reverse may be adopted.

In this case, for example, the connecting member 633 may be configured to be pressed against the connecting component 77 by an elastic member such as a spring so as to be engaged with the connecting component 77, and in reverse rotation, the connecting component 77 may be displaced toward the connecting member 633 along the axial direction D by the reaction force F2 from the developer 8 in a state of being engaged with the connecting member 633 by overcoming the pressing force (spring pressure) of the elastic member.

Further, in this case, even if the transport unit 73 receives the reaction force F1 (FIG. 5) from the developer 8 during a forward rotational operation, the end portion 74*c* of the rotating shaft 74 on the side which is not supported comes into contact with the end surface portion of the front side end structure 72. Therefore, the connecting component 77 may be configured so as not to be displaced in the direction of the reaction force F1 (FIG. 5).

Further, according to the first exemplary embodiment, a helical gear may be incorporated as a transmission gear of the driving transmission mechanism 632 of the rotational drive device 63 of the replenishment drive device 61. With this configuration, when the transport unit 73 of the developer container 7 rotates reversely, the direction of the force applied in the thrust direction in the transmission of the helical gear is opposite to that in the forward rotation. For this reason, when the rotating shaft 74 receives the force in the opposite direction via the connecting component 77, the transport unit 73 of the developer container 7 may be displaced so that the tip end 753Ae of the first transport blade portion 753A passes in contact with the protrusion 79.

Further, in the image forming apparatus 1, the reversing rotation (rR) of the respective transport units 73, 73B and 73C of the developer containers 7, 7B and 7C may be performed independently of another member such as the delivery member 622 which is driven by the replenishment drive device 61. With this configuration, there is no risk that the operation of rotating the transport unit 73, 73B or 73C in reverse may disturb the replenishment operation. Therefore, the transport unit may be configured to rotate, for example, four or more times in reverse.

In addition, the image forming apparatus to which the developer container 7 of the present disclosure is applied may be any other type of image forming apparatus to which the developer container 7 of the present disclosure may be applied, and is not particularly limited as for the form, the type, and the image forming method thereof.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer container comprising:

a container body including a cylindrical accommodating space that accommodates a developer, and a discharge port through which the developer is discharged;

a transport unit configured to transport the developer accommodated in the accommodating space of the container body toward the discharge port by a transport blade that is provided on a rotating shaft existing along a longitudinal direction in the accommodating space, the transport blade being configured to move so as to pass closely to an inner wall of the accommodating space;

a support unit that rotatably supports the rotating shaft of the transport unit, the support unit including a connecting component configured to connect to an external element to receive external rotational power; and a protrusion protruding inward from the inner wall of the accommodating space of the container body, wherein the transport unit is configured such that when the transport unit reversely rotates in an opposite direction to a rotational direction in transporting the developer, the transport blade passes in contact with the protrusion and vibrates so as to touch the inner wall of the accommodating space.

2. The developer container according to claim 1, wherein the transport unit is configured such that the transport blade has a discontinuous shape having a gap in an axial direction of the rotating shaft at at least one location in the axial direction, and the transport unit is configured such that (i) when the transport unit forward rotates in the rotational direction in transporting the developer, the transport unit comes to a state where a discontinuous portion of the transport blade passes without being in contact with the protrusion, and (ii) when the transport unit reversely rotates, the transport unit comes to a state where the transport blade is displaced so as to pass in contact with the protrusion.

3. An image forming apparatus comprising:

a developing device configured to develop a latent image formed on an image carrier;

a developer container comprising a container body including a cylindrical accommodating space that accommodates a developer to be replenished to the developing device, and a discharge port through which the developer is discharged, and a transport unit configured to transport the developer accommodated in the accommodating space toward the discharge port, the developer container being detachably mounted when in use; and a rotational drive unit configured to switch the transport unit of the developer container between (i) forward rotation in a rotational direction in transporting the developer and (ii) reverse rotation in a direction opposite to the rotational direction in the transporting, wherein the developer container according to claim 2 is mounted as the developer container, and the image forming apparatus has a timing of performing a reverse rotational operation of reversely rotating the transport unit of the mounted developer container by the rotational drive unit.

4. The developer container according to claim 1, wherein the protrusion is configured in a shape having a gently inclined surface portion configured to keep the transport blade so as not to touch the inner wall of the accommodating space when the transport unit rotates forward in the rotational direction in transporting the developer and the transport blade passes in contact with the protrusion, and a vibration inducing surface portion configured to vibrate the transport blade so as to touch the inner wall of the accommodating space when the transport unit rotates reversely and the transport blade passes in contact with the protrusion.

5. An image forming apparatus comprising:

a developing device configured to develop a latent image formed on an image carrier;

a developer container comprising a container body including a cylindrical accommodating space that accommodates a developer to be replenished to the developing device, and a discharge port through which the developer is discharged, and a transport unit configured to transport the developer accommodated in the accommodating space toward the discharge port, the developer container being detachably mounted when in use; and a rotational drive unit configured to switch the transport unit of the developer container between (i) forward rotation in a rotational direction in transporting the developer and (ii) reverse rotation in a direction opposite to the rotational direction in the transporting, wherein the developer container according to claim 4 is mounted as the developer container, and the image forming apparatus has a timing of performing a reverse rotational operation of reversely rotating the transport unit of the mounted developer container by the rotational drive unit.

6. The developer container according to claim 1, wherein the transport blade of the transport unit includes a portion formed in a shape having a gently inclined surface portion configured to be kept so as not to touch the inner wall of the accommodating space when the transport unit rotates forward in the rotational direction in transporting the developer and the transport blade passes in contact with the protrusion, and a vibration inducing surface portion configured to vibrate so as to touch the inner wall of the accommodating space when the transport unit rotates reversely and the transport blade passes in contact with the protrusion.

7. An image forming apparatus comprising:

a developing device configured to develop a latent image formed on an image carrier;

a developer container comprising a container body including a cylindrical accommodating space that accommodates a developer to be replenished to the developing device, and a discharge port through which the developer is discharged, and a transport unit configured to transport the developer accommodated in the accommodating space toward the discharge port, the developer container being detachably mounted when in use; and a rotational drive unit configured to switch the transport unit of the developer container between (i) forward rotation in a rotational direction in transporting the developer and (ii) reverse rotation in a direction opposite to the rotational direction in the transporting, wherein the developer container according to claim 6 is mounted as the developer container, and the image forming apparatus has a timing of performing a reverse rotational operation of reversely rotating the transport unit of the mounted developer container by the rotational drive unit.

8. The developer container according to claim 1, wherein the protrusion is provided in a portion of the inner wall that is located above a surface of the developer accommodated in the accommodating space in a gravitational direction when in use.

9. An image forming apparatus comprising:

a developing device configured to develop a latent image formed on an image carrier;

a developer container comprising a container body including a cylindrical accommodating space that accommodates a developer to be replenished to the developing device, and a discharge port through which the developer is discharged, and a transport unit configured to transport the developer accommodated in the accommodating space toward the discharge port, the developer container being detachably mounted when in use; and a rotational drive unit configured to switch the transport unit of the developer container between (i) forward rotation in a rotational direction in transporting the developer and (ii) reverse rotation in a direction opposite to the rotational direction in the transporting, wherein the developer container according to claim 8 is mounted as the developer container, and the image forming apparatus has a timing of performing a reverse rotational operation of reversely rotating the transport unit of the mounted developer container by the rotational drive unit.

10. The developer container according to claim 1, wherein one end of the rotating shaft of the transport unit is supported by the support unit in a cantilever manner, and the protrusion is provided in an area on a side away from the support unit in the longitudinal direction of the accommodating space.

11. An image forming apparatus comprising:

a developing device configured to develop a latent image formed on an image carrier;

a developer container comprising a container body including a cylindrical accommodating space that accommodates a developer to be replenished to the developing device, and a discharge port through which the developer is discharged, and a transport unit configured to transport the developer accommodated in the accommodating space toward the discharge port, the developer container being detachably mounted when in use; and a rotational drive unit configured to switch the transport unit of the developer container between (i) forward rotation in a rotational direction in transporting the developer and (ii) reverse rotation in a direction opposite to the rotational direction in the transporting, wherein the developer container according to claim 10 is mounted as the developer container, and the image forming apparatus has a timing of performing a reverse rotational operation of reversely rotating the transport unit of the mounted developer container by the rotational drive unit.

12. An image forming apparatus comprising:

a developing device configured to develop a latent image formed on an image carrier;

a developer container comprising a container body including a cylindrical accommodating space that accommodates a developer to be replenished to the developing device, and a discharge port through which the developer is discharged, and a transport unit configured to transport the developer accommodated in the accommodating space toward the discharge port, the developer container being detachably mounted when in use; and a rotational drive unit configured to switch the transport unit of the developer container between (i) forward rotation in a rotational direction in transporting the developer and (ii) reverse rotation in a direction opposite to the rotational direction in the transporting, wherein the developer container according to claim 1 is mounted as the developer container, and the image forming apparatus has a timing of performing a reverse rotational operation of reversely rotating the transport unit of the mounted developer container by the rotational drive unit.

13. The image forming apparatus according to claim 12, further comprising:

an estimating unit configured to estimate a remaining amount of the developer accommodated in the developer container, wherein the rotational drive unit performs the reverse rotational operation when the estimating unit estimates that the remaining amount of the developer is 50% or less.

14. The image forming apparatus according to claim 13, wherein the rotational drive unit performs the reverse rotational operation within a range in which the transport unit rotates one or more times and three or less times.

15. The image forming apparatus according to claim 13, wherein the rotational drive unit performs the reverse rotational operation at a timing other than during an image forming operation.

16. The image forming apparatus according to claim 12, wherein the rotational drive unit performs the reverse rotational operation within a range in which the transport unit rotates one or more times and three or less times.

17. The image forming apparatus according to claim 16, wherein the rotational drive unit performs the reverse rotational operation at a timing other than during an image forming operation.

18. The image forming apparatus according to claim 12, wherein the rotational drive unit performs the reverse rotational operation at a timing other than during an image forming operation.

19. A developer container comprising:

a container body including a cylindrical accommodating space that accommodates a developer, and a discharge port through which the developer is discharged;

transport means for transporting the developer accommodated in the accommodating space of the container body toward the discharge port by a transport blade that is provided on a rotating shaft existing along a longitudinal direction in the accommodating space, the transport blade being configured to move so as to pass closely to an inner wall of the accommodating space;

support means that rotatably supports the rotating shaft of the transport means, the support means including connecting means for connecting to an external element to receive external rotational power; and a protrusion protruding inward from the inner wall of the accommodating space of the container body, wherein the transport means is configured such that when the transport means reversely rotates in an opposite direction to a rotational direction in transporting the developer, the transport blade passes in contact with the protrusion and vibrates so as to touch the inner wall of the accommodating space.

* * * * *